US007753117B2

(12) United States Patent
Ramakrishnan et al.

(10) Patent No.: US 7,753,117 B2
(45) **Date of Patent: *Jul. 13, 2010**

(54) TOOL AND METHOD FOR EVALUATING FLUID DYNAMIC PROPERTIES OF A CEMENT ANNULUS SURROUNDING A CASING

(75) Inventors: Terizhandur S. Ramakrishnan, Boxborough, MA (US); Nikita V. Chugunov, Arlington, MA (US); Andrew Duguid, Moon Township, PA (US); John Tombari, Spring, TX (US)

(73) Assignee: Schlumberger Technology Corporation, Cambridge, MA (US)

( * ) Notice: Subject to any disclaimer, the term of this patent is extended or adjusted under 35 U.S.C. 154(b) by 100 days.

This patent is subject to a terminal disclaimer.

(21) Appl. No.: 12/098,041

(22) Filed: Apr. 4, 2008

(65) Prior Publication Data

US 2009/0250208 A1 Oct. 8, 2009

(51) Int. Cl.
*E21B 47/00* (2006.01)

(52) U.S. Cl. ..... 166/250.02; 166/100; 175/78; 73/152.27

(58) Field of Classification Search ..... 166/250.02, 166/255.1, 100, 253.1; 175/78; 73/152.05, 73/152.27

See application file for complete search history.

(56) References Cited

U.S. PATENT DOCUMENTS 2,739,475 A * 3/1956 Nowak ..... 73/152.12
4,551,823 A 11/1985 Carmichael et al.
4,608,859 A * 9/1986 Rockley ..... 73/152.07
4,933,638 A * 6/1990 Kleinberg et al. ..... 324/303
5,269,180 A 12/1993 Dave et al.
5,602,334 A 2/1997 Proett et al.
5,660,234 A * 8/1997 Hebert et al. ..... 166/368
5,692,565 A 12/1997 MacDougall et al.
6,568,487 B2 5/2003 Meister et al.
6,856,132 B2 * 2/2005 Appel et al. ..... 324/303
6,941,231 B2 9/2005 Zeroug et al.
7,178,392 B2 2/2007 Dhruva et al.

(Continued)

FOREIGN PATENT DOCUMENTS

WO 2007/124041 A2 11/2007

OTHER PUBLICATIONS

Wilkinson, D. et al., A Perturbation Method for Mixed Boundary-Value Problems in Pressure Transient Testing, Transport in Porous Media, 5, pp. 609-636, 1990.

(Continued)

*Primary Examiner*—David J Bagnell
*Assistant Examiner*—Catherine Loikith
(74) *Attorney, Agent, or Firm*—Vincent Loccisano; James McAleenan; Brigid Laffey

(57) ABSTRACT

The permeability of the cement annulus surrounding a casing is measured by locating a tool inside the casing, placing a probe of the tool in contact with the cement annulus, measuring the change of pressure in the probe over time, where the change in pressure over time is a function of among other things, the initial probe pressure, the formation pressure, and the permeability, and using the measured change over time to determine an estimated permeability. The estimated permeability is useful in determining whether carbon dioxide can be effectively sequestered in the formation below or at the depth of measurement without significant leakage through the cement annulus.

17 Claims, 5 Drawing Sheets

U.S. PATENT DOCUMENTS

| | | | | |
|---|---|---|---|---|
| 7,266,983 | B2 | 9/2007 | Krueger et al. | |
| 2004/0144533 | A1* | 7/2004 | Zazovsky | 166/250.02 |
| 2005/0148080 | A1* | 7/2005 | Herron | 436/5 |
| 2009/0007651 | A1* | 1/2009 | Ramakrishan et al. | 73/152.51 |

OTHER PUBLICATIONS

Ramakrishnan, T.S. et al., A Laboratory Investigation of Permeability in Hemispherical Flow With Application to Formation Testers, Society of Petroleum Engineers Formation Evaluation, pp. 99-108, Jun. 1995.

Weber, H., Ueber die Besselschen Functionen und ihre Anwendung auf die Theorie elektrischen Strome., Journal fur Math, vol. 75, pp. 75-105, 1873.

Gray, A., et al., A Treatise on Bessel Functions and Their Applications to Physics, MacMillian and Co., Limited, Lomdon, pp. 139-149, 1952.

* cited by examiner

TOOL AND METHOD FOR EVALUATING FLUID DYNAMIC PROPERTIES OF A CEMENT ANNULUS SURROUNDING A CASING

BACKGROUND OF THE INVENTION

1. Field of the Invention

This invention relates broadly to the in situ testing of a cement annulus located between a well casing and a formation. More particularly, this invention relates to methods and apparatus for an in situ testing of the permeability of a cement annulus located in an earth formation. While not limited thereto, the invention has particular applicability to locate formation zones that are suitable for storage of carbon dioxide in that the carbon dioxide will not be able to escape the formation zone via leakage through a permeable or degraded cement annulus.

2. State of the Art

After drilling an oil well or the like in a geological formation, the annular space surrounding the casing is generally cemented in order to consolidate the well and protect the casing. Cementing also isolates geological layers in the formation so as to prevent fluid exchange between the various formation layers, where such exchange is made possible by the path formed by the drilled hole. The cementing operation is also intended to prevent gas from rising via the annular space and to limit the ingress of water into the production well. Good isolation is thus the primary objective of the majority of cementing operations carried out in oil wells or the like.

Consequently, the selection of a cement formulation is an important factor in cementing operations. The appropriate cement formulation helps to achieve a durable zonal isolation, which in turn ensures a stable and productive well without requiring costly repair. Important parameters in assessing whether a cement formulation will be optimal for a particular well environment are the mechanical properties of the cement after it sets inside the annular region between casing and formation. Compressive and shear strengths constitute two important cement mechanical properties that can be related to the mechanical integrity of a cement sheath. These mechanical properties are related to the linear elastic parameters namely: Young's modulus, shear modulus, and Poisson's ratio. It is well known that these properties can be ascertained from knowledge of the cement density and the velocities of propagation of the compressional and shear acoustic waves inside the cement.

In addition, it is desirable that the bond between the cement annulus and the well-bore casing be a quality bond. Further, it is desirable that the cement pumped in the annulus between the casing and the formation completely fills the annulus.

Much of the prior art associated with in situ cement evaluation involves the use of acoustic measurements to determine bond quality, the location of gaps in the cement annulus, and the mechanical qualities (e.g., strength) of the cement. For example, U.S. Pat. No. 4,551,823 to Carmichael et al. utilizes acoustic signals in an attempt to determine the quality of the cement bond to the borehole casing. U.S. Pat. No. 6,941,231 to Zeroug et al. utilizes ultrasonic measurements to determine the mechanical qualities of the cement such as the Young's modulus, the shear modulus, and Poisson's ratio. These non-invasive ultrasonic measurements are useful as opposed to other well known mechanical techniques whereby samples are stressed to a failure stage to determine their compressive or shear strength.

Acoustic tools are used to perform the acoustic measurements, and are lowered inside a well to evaluate the cement integrity through the casing. While interpretation of the acquired data can be difficult, several mathematical models have been developed to simulate the measurements and have been very helpful in anticipating the performance of the evaluation tools as well as in helping interpret the tool data. The tools, however, do not measure fluid dynamic characteristics of the cement.

SUMMARY OF THE INVENTION

The present invention is directed to measuring a fluid dynamic property of a cement annulus surrounding a borehole casing. A fluid dynamic property of the cement annulus surrounding a casing is measured by locating a tool inside the casing, placing a probe of the tool in contact with the cement annulus, measuring the change of pressure in the probe over time, where the change in pressure over time is a function of among other things, the initial probe pressure, the formation pressure, and the fluid dynamic property of the cement, and using the measured change over time to determine an estimated fluid dynamic property.

The present invention is also directed to finding one or more locations in a formation for the sequestration of carbon dioxide. A locations (depth) for sequestration of carbon dioxide is found by finding a high porosity, high permeability formation layer (target zone) having large zero or near zero permeability and preferably inert (non-reactive) cap rocks surrounding the target zone, and testing the permeability of the cement annulus surrounding the casing at that zone to insure that carbon dioxide will not leak through the cement annulus at an undesirable rate. Preferably, the cement annulus should have a permeability in the range of microDarcys.

According to one aspect of the present invention, when a cement annulus location is chosen for testing, a well-bore tool is used to drill through the casing. The torque on the drill is monitored, and when the torque changes significantly (i.e., the drill has broken through the casing and reached the cement annulus), the drilling is stopped and the pressure probe is set against the cement.

According to another aspect of the invention, prior to drilling the casing, the casing is evaluated for corrosion in order to estimate the thickness of the casing. Then, the penetration movement of the drill and the torque on the drill are both monitored. If a torque change is found after the drill has moved within a reasonable deviation from the estimated thickness, the drilling is stopped and the pressure probe is set. If a torque change is not found, or in any event, the drilling is stopped after the drill has moved a distance of the estimated thickness plus a reasonable deviation.

DETAILED DESCRIPTION OF THE PREFERRED EMBODIMENTS

Figure 1:
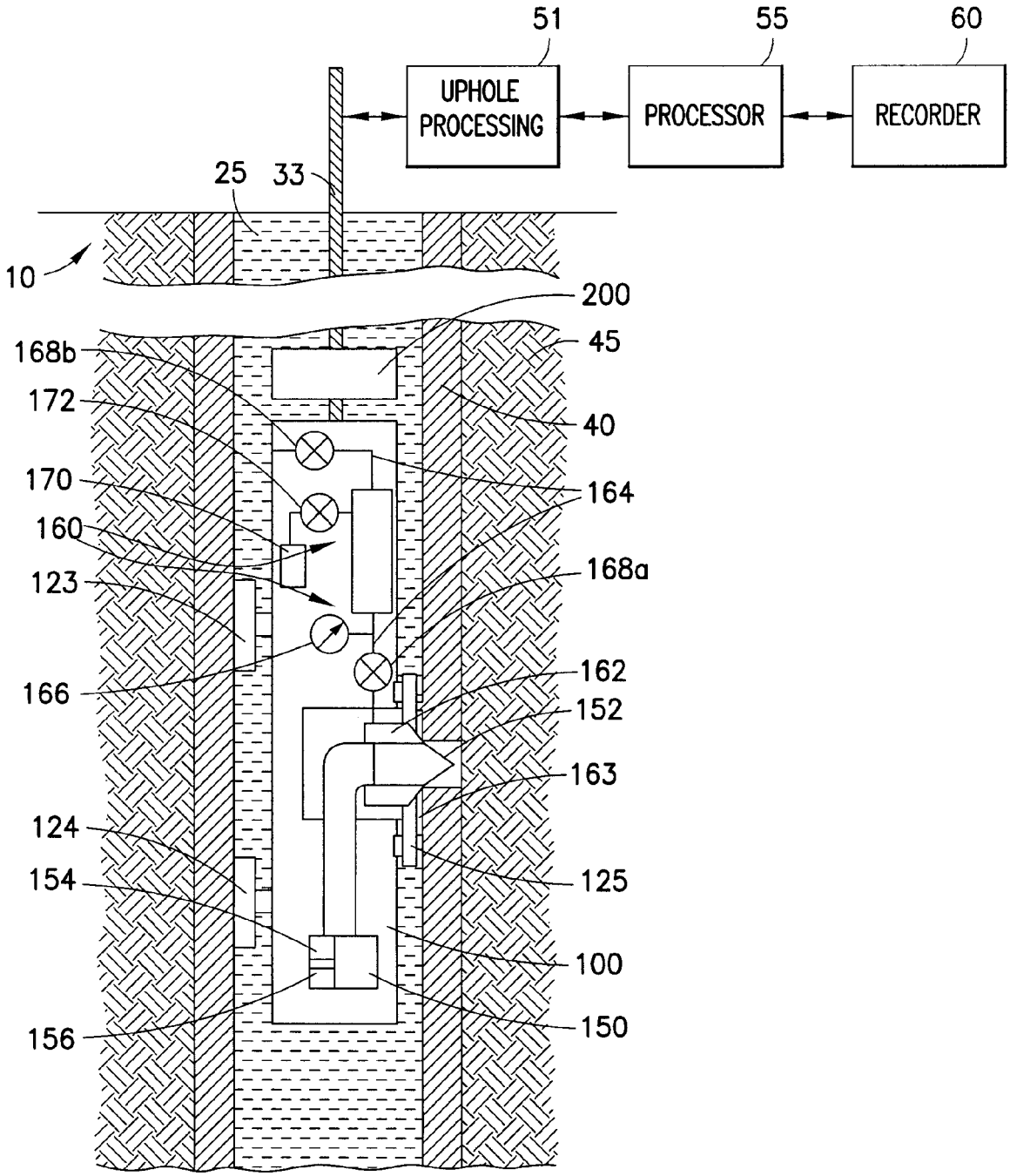
FIG. 1 is a schematic diagram partly in block form of an apparatus of the invention located in a well-bore capable of practicing the method of the invention.

Turning now to FIG. 1, a formation 10 is shown traversed by a well-bore 25 (also called a borehole) which is typically, although not necessarily filled with brine or water. The illustrated portion of the well-bore is cased with a casing 40. Surrounding the casing is a cement annulus 45 which is in contact with the formation 10. A device or logging tool 100 is suspended in the well-bore 25 on an armored multi-conductor cable 33, the length of which substantially determines the location of the tool 100 in the well-bore. Known depth gauge apparatus (not shown) may be provided to measure cable displacement over a sheave wheel (not shown), and thus the location of the tool 100 in the borehole 25, adjusted for the cable tension. The cable length is controlled by suitable means at the surface such as a drum and winch mechanism (not shown). Circuitry 51 shown at the surface of the formation 10 represents control, communication, and preprocessing circuitry for the logging apparatus. This circuitry, some of which may be located downhole in the logging tool 100 itself, may be of known type. A processor 55 and a recorder 60 may also be provided uphole.

The tool 100 may take any of numerous formats and has several basic aspects. First, tool 100 preferably includes a plurality of tool-setting piston assemblies 123, 124, 125 or other engagement means which can engage the casing and stabilize the tool at a desired location in the well-bore. Second, the tool 100 has a drill with a motor 150 coupled to a drill bit 152 capable of drilling through the casing 40. In one embodiment, a torque sensor 154 is coupled to the drill for the purpose of sensing the torque on the drill as described below. In another embodiment, a displacement sensor 156 is coupled to the drill motor and/or the drill bit for sensing the lateral distance the drill bit moves (depth of penetration) for the purposes described below. Third, the tool 100 has a hydraulic system 160 including a hydraulic probe 162, a hydraulic line 164, and a pressure sensor 166. The probe 162 is at one end of and terminates the hydraulic line 164 and is sized to fit or stay in hydraulic contact with the hole in the casing drilled by drill bit 152 so that it hydraulically contacts the cement annulus 45. This may be accomplished, by way of example and not by way of limitation, by providing the probe with an annular packer 163 or the like which seals on the casing around the hole drilled by the drill bit. The probe may include a filter valve (not shown). In one embodiment, the hydraulic line 164 is provided with one or more valves 168*a* and 168*b* which permit the hydraulic line 164 first to be pressurized to the pressure of the well-bore, and which also permit the hydraulic line 164 then to be hydraulically isolated from the well-bore. In another embodiment, hydraulic line 164 first can be pressurized to a desired pressure by a pump 170, and then isolated therefrom by one or more valves 172. In the shown embodiment, the hydraulic line can be pressurized by either the pressure of the well-bore or by the pump 170. In any event, the pressure sensor 166 is coupled to the hydraulic line and senses the pressure of the hydraulic line 164. Fourth, the tool 100 includes electronics 200 for at least one of storing, pre-processing, processing, and sending uphole to the surface circuitry 51 information related to pressure sensed by the pressure sensor 166. The electronics 200 may have additional functions including: receiving control signals from the surface circuitry 51 and for controlling the tool-setting pistons 123, 124, 125, controlling the drill motor 150, and controlling the pump 170 and the valves 168*a*, 168*b*, 172. Further, the electronics 200 may receive signals from the torque sensor 154 and/or the displacement sensor 156 for purposes of controlling the drilling operation as discussed below. It will be appreciated that given the teachings of this invention, any tool such as the Schlumberger CHDT (a trademark of Schlumberger) which includes tool-setting pistons, a drill, a hydraulic line and electronics, can be modified, if necessary, with the appropriate sensors and can have its electronics programmed or modified to accomplish the functions of tool 100 as further described below. Reference may be had to, e.g., U.S. Pat. No. 5,692,565 which is hereby incorporated by reference herein.

As will be discussed in more detail hereinafter, according to one aspect of the invention, after the tool 100 is set at a desired location in the well-bore, the drill 150, under control of electronics 200 and/or uphole circuitry 51 is used to drill through the casing 40 to the cement annulus 45. The probe 162 is then preferably set against the casing around the drilled hole so that it is in hydraulic contact with the drilled hole and thus in hydraulic contact with the cement annulus 45. With the probe 162 set against the casing, the packer 163 provides hydraulic isolation of the drilled hole and the probe from the wellbore when valve 168*b* is also shut. Alternatively, depending on the physical arrangement of the probe, it is possible that the probe could be moved into the hole and in direct contact with the cement annulus. Once set with the probe (and hydraulic line) isolated from the borehole pressure, the pressure in the probe and hydraulic line is permitted to float (as opposed to be controlled by pumps which conduct drawdown or injection of fluid), for a period of time. The pressure is monitored by the pressure sensor coupled to the hydraulic line, and based on the change of pressure measured over time, a fluid dynamic property of the cement (e.g., permeability) is calculated by the electronics 200 and/or the uphole circuitry 51. A record of the determination may be printed or shown by the recorder.

In order to understand how a determination of a fluid dynamic property of the cement may be made by monitoring the pressure in the hydraulic line connected to the probe over time, an understanding of the theoretical underpinnings of the invention is helpful. Translating into a flow problem a problem solved by H. Weber, "Ueber die besselschen functionen und ihre anwendung auf die theorie der electrischen strome", *Journal fur Math.,* 75:75-105 (1873) who considered the charged electrical disk potential in an infinite medium, it can be seen that the probe-pressure $p_p$ within the probe of radius $r_p$, with respect to the far-field pressure is $$p_p = \frac{Q\mu}{4kr_p}. \tag{1}$$

when a fluid of viscosity $\mu$ is injected at rate Q into a formation of permeability k. Here, the probe area is open to flow. For all radii greater than radius $r_p$, i.e., for radii outside of the probe, no flow is allowed to occur.

The infinite medium results of Weber (1873) were modified by Ramakrishnan, et al. "A laboratory investigation of permeability in hemispherical flow with application to formation testers", *SPE Form. Eval.,* 10:99-108 (1995) as a result of laboratory experiments. One of the experiments deals with the problem of a probe placed in a radially infinite medium of thickness "l". For this problem, a small correction to the infinite medium result applies and is given by:

$$p_p = \frac{Q\mu}{4kr_p}\left[1 - \frac{2r_p \ln 2}{\pi l} + o\left(\frac{r_p}{l}\right)\right] \quad (2)$$

where "o" is an order indication showing the last term to be small relative to the other terms and can be ignored. This result is applicable when the boundary at "l" is kept at a constant pressure (which is normalized to zero). The boundary condition at the interface of the casing and the cement (z=0, see FIG. 2) is the same as in the case of the cement constituting an infinite medium.

Turning now to the tool in the well-bore, before the probe is isolated from the well-bore, it may be assumed that the fluid pressure in the tool is $p_w$ which is the well-bore pressure at the depth of the tool. In a cased hole, the well-bore fluid may be assumed to be clean brine, and the fluid in the hydraulic probe line is assumed to contain the same brine, although the probe line may be loaded with a different fluid, if desired. At the moment the probe is set (time t=0), the pressure of the fluid in the tool is $p_w$, and the tool fluid line is isolated, e.g., through the use of one or more valves, except for any leak through the cement into or from the formation. This arrangement amounts to a complicated boundary value problem of mixed nature. See, Wilkinson and Hammond, "A perturbation method for mixed boundary-value problems in pressure transient testing", *Trans. Porous Media,* 5:609-636 (1990). The pressure at the open cylinder probe face and in the flow line is uniform, and flow may occur into and out of it with little frictional resistance in the tool flow line itself, and is controlled entirely by the permeability of the cement and the formation. The pressure inside the tool (probe) is equilibrated on a fast time scale, because hydraulic constrictions inside the tool are negligible compared to the resistance at the pore throats of the cement or the formation. Due to the casing, no fluid communication to the cement occurs outside the probe interface.

Although the mixed boundary problem is arguably unsolvable, approximations may be made to make the problem solvable. First, it may be assumed that the cement permeability is orders of magnitude smaller than the formation permeability, and thus the ratio of the cement to formation permeability approaches zero. By ignoring the formation permeability, pressure from the far-field is imposed at the cement-formation interface; i.e., on a short enough time scale compared to the overall transient for pressure in the tool to decay through the cement, pressure dissipation to infinity occurs. Without loss of generality, the pressure gradient in the formation can be put to be zero. In addition, for purposes of simplicity of discussion, the physical formation pressure in the formulation can be subtracted in all cases to reduce the formation pressure to zero in the equations. This also means that the probe pressure calculated is normalized as the difference between the actual probe pressure and the physical formation pressure. By neglecting formation resistance (i.e., by setting the pressure gradient in the formation to zero), it should be noted that the computed cement permeability is likely to be slightly smaller than its true value.

In addition, extensive work has been carried out with regard to the influence of the well-bore curvature in terms of a small parameter $r_p/r_w$ (the ratio of the probe radius to the well-bore radius). This ratio is usually small, about 0.05. Since the ratio is small, the well-bore may be treated as a plane from the perspective of the probe. Thus, the pressure drop obtained is correct to a leading order, since it is dominated by gradients near the well-bore and the curvature of the well-bore does not strongly influence the observed steady-state pressures.

Now a second approximation may be made to help solve the mixed boundary problem. There is a time scale relevant to pressure propagation through the cement. If the cement thickness is $l_c$ (see FIG. 2), this time scale is $t_c=\phi\mu c l_c^2/k_c$, where $\phi$ is the porosity of the cement, $k_c$ is the cement permeability, and c is the compressibility of the fluid saturating the pore space of the cement annulus. Within this time scale, however, pressure at the probe is well established because much of the pressure drop occurs within a few probe radii. Since the cement thickness is several probe radii, it is convenient to consider a hemispherical pore volume of $$V_c = \phi\frac{2}{3}\pi l_c^3$$

of the cement adjacent the probe for comparison with the volume of the tool $V_t$ to estimate the influence of storage. Tool fluid volume connected to the probe is a few hundred mL, where $V_c$ is measured in tens of mL. To leading order, the pressure experienced at the probe is as though a steady flow has been established in the cement region. The transient seen by the probe would be expected to be dominated by storage, with the formation being in a pseudo-steady state.

Figure 2:
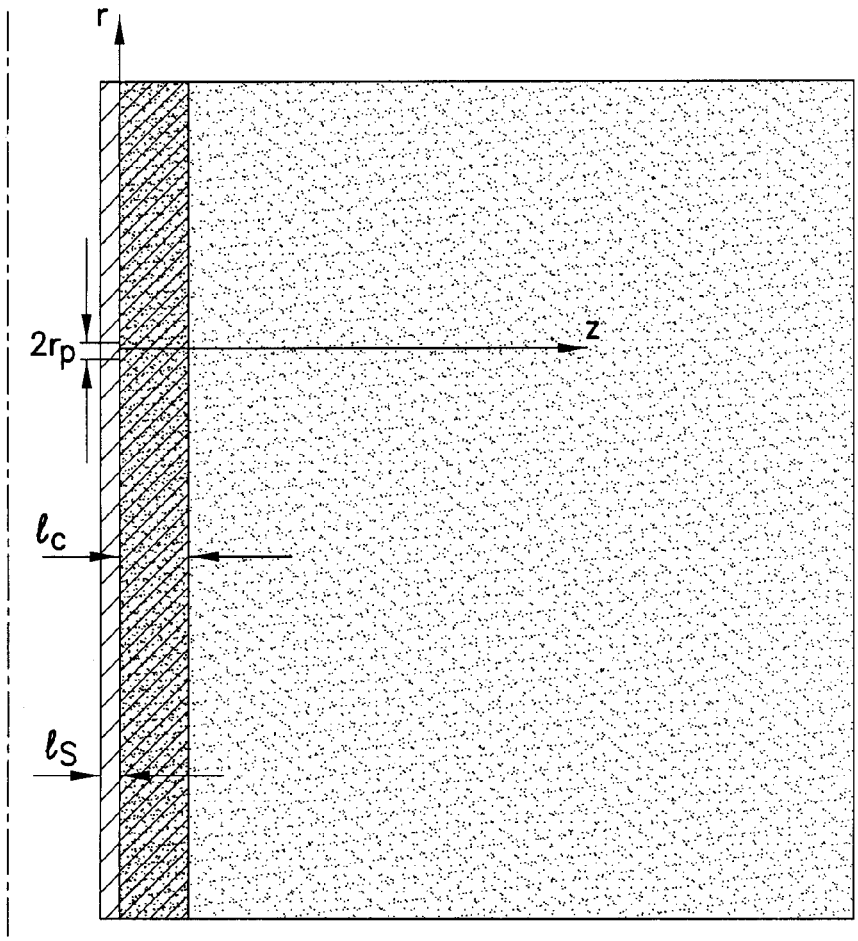
FIG. 2 is a schematic showing the casing, the cement annulus, and various parameters.

With the pressure in the cement region assumed to be at a steady-state, and with the curvature of the well-bore being small enough to be neglected, and with the probe assumed to be set in close proximity to the inner radius of the cement just past the casing, the following equations apply:

$$\frac{\partial^2 p}{\partial z^2} + \frac{1}{r}\frac{\partial}{\partial r}\left(r\frac{\partial p}{\partial r}\right) = 0 \quad (3)$$

$$p = 0,\ \forall\, r,\ z = l_c \quad (4)$$

$$\frac{\partial p}{\partial z} = 0,\ z = 0,\ r > r_p \quad (5)$$

where, as indicated in FIG. 2, z is the coordinate projecting into the formation, r is the radial distance from the center of the probe along the probe face, $r_p$ is the radius of the probe. As will be appreciated, equation (3) is a mass conservation equation which balances fluid movement in the z and r directions. Equation (3) is not a function of time because, as set forth above, it is assumed that the cement is at a steady state. Equation (4) dictates that at the cement-formation interface (i.e., when z equals the cement thickness $l_c$), the difference between the formation pressure and the pressure found at the interface (i.e., p is the normalized pressure) is zero. Equation (5) dictates that at the cement-casing interface beyond the location of the probe, there is no pressure gradient in the cement. Additionally, conditions for flow at the probe can be defined according to:

$$p = p_p,\ \forall\, r < r_p,\ z = 0 \quad (6)$$

$$2\pi\int_0^{r_p} r q(r)\,dr = Q \quad (7)$$

where Q is the total flow through the probe, and q(r) is the flux which is equal to $$-\frac{k}{\mu}\frac{\partial p}{\partial z}$$

in the cement at z=0 and $r<r_p$; i.e., at the probe-cement interface. Equation (6) suggests that for all locations within the radius of the probe normalized pressure p is the normalized probe pressure (i.e., the actual probe pressure minus the formation pressure). Equation (7) suggests that the total flow Q seen by the probe is an integral of the flux which relates to the pressure difference, the permeability of the cement and the viscosity of the fluid.

When the well-bore pressure to which the probe is initially set is larger than the formation fluid pressure, fluid leaks from the tool into the formation via the probe and through the cement. When the formation fluid pressure is larger than the probe pressure, fluid leaks from the formation via the cement into the tool. For purposes of discussion herein, it will be assumed that the well-bore pressure (initial probe pressure) is larger, although the arrangement will work just as well for the opposite case with signs being reversed. When the pressures are different, and the initial pressure in the probe is $p_w$, the leak rate is governed by the pressure difference $p_w$, the differential equations and boundary conditions set forth in equations (3) through (7) above, and the (de)compression of the fluid in the tool. Understandably, because the borehole fluid is of low compressibility, the fractional volumetric change will be very small. For example, if the compressibility of the fluid is a typical $10^{-9}$ $m^2N^{-1}$, and the difference in the pressure is 6 MPa, the fractional volume change would be 0.006 (0.6%) until equilibrium is reached. For a storage volume of 200 mL, a volume change of 1.2 mL would occur over the entire test. This volume can flow through a cement having a permeability of 1 μD at a time scale of an hour. As is described hereinafter, by measuring the pressure change over a period of several minutes, a permeability estimate can be obtained by fitting the obtained data to a curve.

As previously indicated, the fluid in the tool equilibrates pressure on a time scale which is much shorter than the overall pressure decay dictated by the low permeabilities of the cement annulus. Therefore, the fluid pressure at the probe $p_p$ is the same as the fluid pressure measured in the tool $p_t$. If all properties of the fluid within the tool are shown with subscript t, the volume denoted $V_t$, and the net flow out of the tool is Q, a mass balance (mass conservation) equation for the fluid in the tool may be written according to:

$$V_t\frac{d\rho_t}{dt}+\rho_t\frac{dV_t}{dt}=-\rho_t Q \tag{8}$$

where $\rho_t$ is the density of the fluid in the tool. The fluid volume of the system $V_t$ coupled to the probe is fixed. Using the isothermal equation of state for a fluid of small compressibility $$\frac{1}{\rho}\frac{\partial\rho}{\partial p}=c \tag{9}$$

where c is the compressibility ($c_t$ being the compressibility for the tool fluid), and substituting equation (9) into equation (8) yields:

$$V_t c_t\frac{dp_p}{dt}=-Q \tag{10}$$

Equation (10) states that the new flow of fluid out of the tool is equal to the volume of the hydraulic system of the tool times the rate of change in probe pressure.

It has already been shown in equation (2) that the probe pressure and the flow rate from the tool are related when the pressure is fixed at a distance of z=l. Replacing 1 with the thickness of the cement $l_c$, and replacing the permeability k with $k_c$, equation (2) can be rewritten and revised to the order ($r_p/l_c$) according to:

$$Q=p_p\left(\frac{4kr_p}{\mu}\right)\frac{1}{1-\frac{2\ln 2}{\pi}\frac{r_p}{l_c}} \tag{11}$$

Now, substituting equation (10) into equation (11) for Q yields:

$$\frac{dp_p}{dt}=-\frac{p_p}{V_t c_t}\left(\frac{4k_c r_p}{\mu}\right)\frac{1}{1-\frac{2\ln 2}{\pi}\frac{r_p}{l_c}} \tag{12}$$

the solution of which gives rise to an exponential decay to formation pressure $$p_p=p_w\exp(-t/\tau) \tag{13}$$

where τ is the relaxation time constant of the pressure in the probe (hydraulic line) of the tool. Equation (13) suggests that the normalized probe pressure is equal to the normalized initial probe (well-bore) pressure (i.e., the difference in pressure between the initial probe (well-bore) pressure and the formation pressure) times the exponential decay term. The relaxation time constant τ of the pressure in the probe can then be determined as $$\tau=V_t c_t\frac{\mu}{4k_c r_p}\left[1-\frac{2\ln 2}{\pi}\frac{r_p}{l_c}\right]. \tag{14}$$

Rearranging equation (14) yields:

$$k_c=V_t c_t\frac{\mu}{4\tau r_p}\left[1-\frac{2\ln 2}{\pi}\frac{r_p}{l_c}\right]. \tag{15}$$

From equation (15) it is seen that the permeability of the cement annulus surrounding the casing can be calculated provided certain values are known, estimated, or determined. In particular, the volume of the hydraulic line of the tool $V_t$ and the radius of the probe $r_p$ are both known. The viscosity of the fluid μ in the hydraulic line of the tool is either known, easily estimated, or easily determined or calculated. The thickness of the cement $l_c$ is also either known or can be estimated or determined from acoustic logs known in the art. The compressibility of the fluid $c_t$ in the hydraulic line of the tool is either known or can be estimated or determined as will be discussed hereinafter. Finally, the relaxation time constant $\tau$ of the pressure in the hydraulic line of the tool can be found as discussed hereinafter by placing the hydraulic probe of the tool against the cement and measuring the pressure decay.

According to one aspect of the invention, the compressibility of the fluid $c_t$ in the hydraulic line of the tool is determining by making an in situ compressibility measurement. More particularly, an experiment is conducted on the hydraulic line of the tool whereby a known volume of expansion is imposed on the fixed amount of fluid in the system, and the change in flow-line pressure is detected by the pressure sensor. The compressibility of the fluid is then calculated according to $$c_t = -\frac{1}{V}\frac{\Delta V}{\Delta p} \tag{16}$$

where V is the volume of the flow-line, $\Delta V$ is the expansion volume added to the flow line, and $\Delta p$ is the change in pressure. Alternatively, a known amount of fluid can be forced into a fixed volume area, and the change in pressure measured. In other cases, the compressibility of the fluid may already be known, so no test is required.

Figure 3:
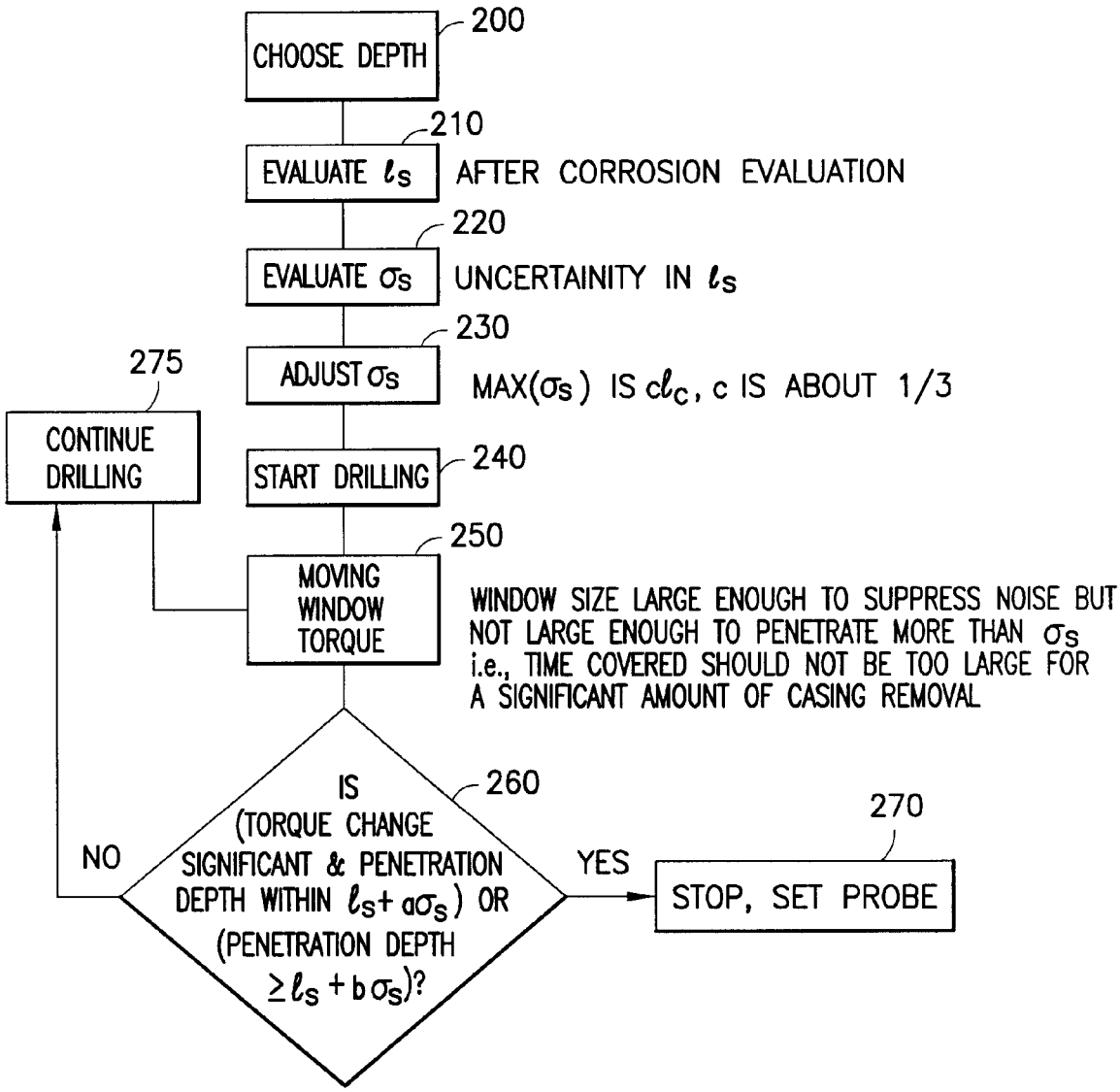
FIG. 3 is a flow chart showing the method of one aspect of the invention related to drilling the casing.

According to another aspect of the invention, prior to placing the probe in contact with the cement annulus, the casing around which the cement annulus is located is drilled. The drilling is preferably conducted according to steps shown in FIG. 3. Thus, at 200, the depth in the well-bore at which the test is to be conducted is selected. The depth is preferably selected by reviewing cement bond logs as well as corrosion logs which indicate a reasonably robust casing. Such logs are well known in the art. It is noted that poor bonding is usually an indication of poor cement, and it is desirable to measure cement permeability in such zones and also in those zones where the cement appears robust. Generally, it is desirable to have at least robust casing and cement zones above those where the cement is found to be inadequate. If robust zones are not found, remedial action could be indicated. Regardless, at 210, the thickness of the casing is evaluated. The true casing thickness $l_s$ (see FIG. 2) is defined by $l_s \approx l_{s0} - l_r$, where $l_{s0}$ is the initial thickness of the steel, and $l_r$ is the reduction in the thickness (ostensibly due to corrosion). At 220, based on corrosion logs which may be available, the uncertainty $\sigma_s$ in the casing thickness is evaluated, and at 230 the uncertainty is optionally adjusted so that the maximum uncertainty equals a constant (e.g., ⅓) times the cement thickness $l_c$ (see FIG. 2); $\max(\sigma_s)=(⅓)l_c$. At 240, the tool is used to drill into the casing and the penetration depth of the drill bit and the drilling torque are monitored by the appropriate sensors. When the steel-cement interface is reached, the torque at the motor will decrease substantially. However, as the steel casing is drilled, it is common for the torque to fluctuate. Thus, as indicated at 250, the torque determined by the torque monitor is assessed (averaged) over a moving time window which is large enough to suppress noise but not large enough for a significant penetration of the bit into the casing. As the penetration depth of $l_s$ is approached (i.e., penetration depth$=l_s \pm \sigma_s$), any sudden change in torque as determined at 260, usually a drop, is indicative of reaching the steel-cement interface. If there is a sudden change, drilling is stopped at 270 and the probe is set. If no change in torque is detected at 260, drilling continues at 275 and measurement of the torque is continued until a change in torque is detected or until the bit has penetrated a distance equal to or larger than $l_s + \max\sigma_s$. If the bit has penetrated that distance without a change in torque being detected, the drilling is stopped and it is assumed that the steel casing has been fully penetrated.

Figure 4:
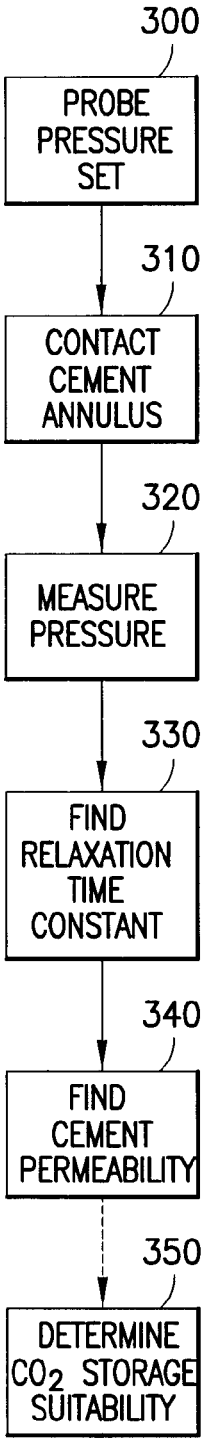
FIG. 4 is a flow chart showing another aspect of the invention related to testing the permeability of the cement annulus.
Figure 8:
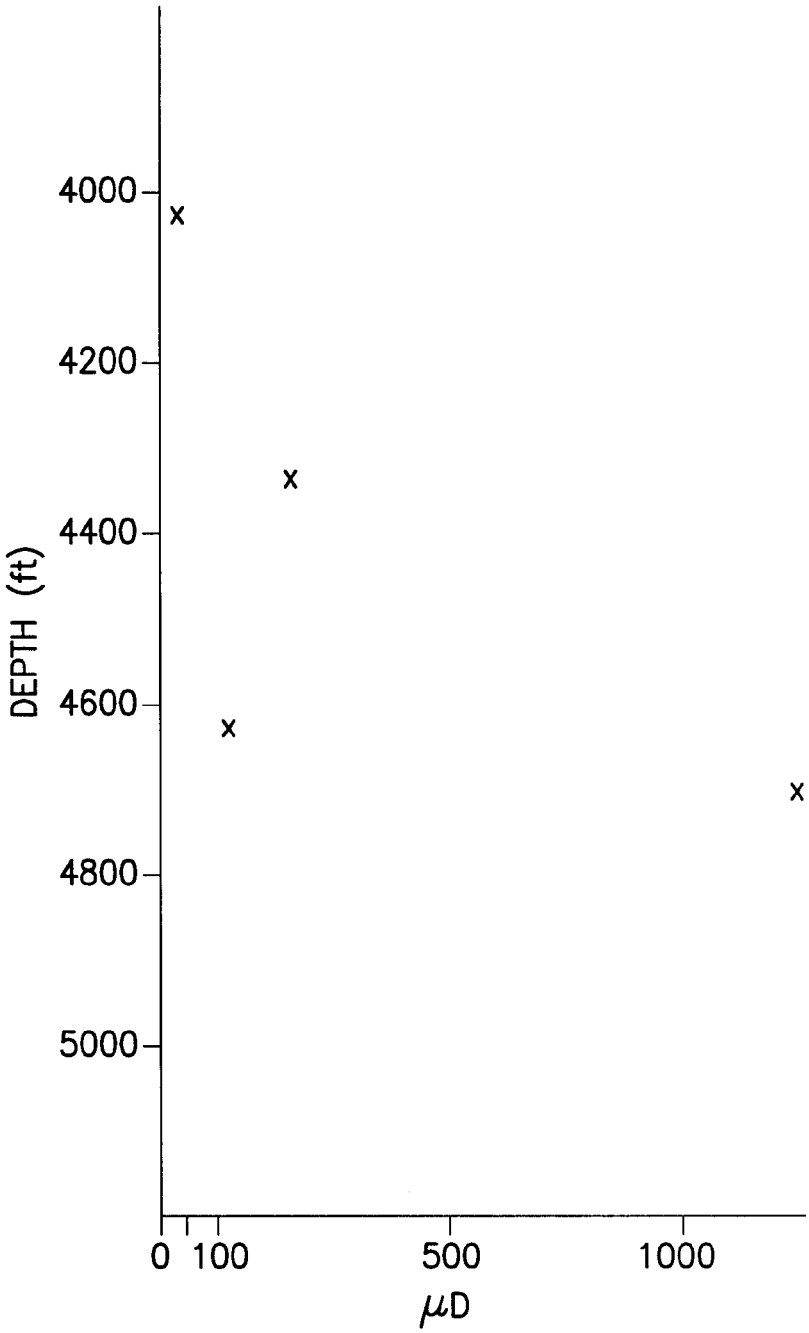
FIG. 8 is a log of cement annulus permeability determinations.

With all the variables of equation (15) known or determined, with the exception of the relaxation time constant, the procedure for determining the cement permeability is straightforward. According to one embodiment of the invention as seen in FIG. 4, once the tool has been located at a desired location in the well-bore and the casing has been drilled as discussed above with reference to FIG. 3, the probe pressure in the probe (hydraulic line of the tool) is set at 300 to a determined value, e.g., the pressure of the well-bore. If the probe is not already in place around the drilled hole, the probe is then placed about or in the hole drilled by the drill and thus in hydraulic contact with the cement annulus at 310. With an elastomeric packer 163 around the probe, the hydraulic line is isolated from the borehole typically by closing a valve 168*b* connecting the hydraulic line to the borehole. Now, with the probe in hydraulic contact with the cement annulus only, and with no action taken (i.e., the process is "passive" as no piston or pump is used to exert a draw-down pressure or injection pressure), the pressure in the hydraulic line is allowed to float so that it decays (or grows) slowly toward the formation pressure. The pressure decay is measured at 320 over time by the pressure sensor of the tool. If the pressure does not decay (e.g., because the formation pressure and the pressure in the hydraulic line are the same), the probe pressure may be increased or decreased and then let float to permit the probe pressure to be measured for a decay or growth. Using the pressure decay data, the relaxation time constant $\tau$ and optionally the starting probe pressure and formation pressures are found using a suitably programmed processor (such as a computer, microprocessor or a DSP) via a best fit analysis (as discussed below) at 330. Once the relaxation time constant is determined, the processor determines permeability of the cement at 340 according to equation (15). A determination of the suitability for storing carbon dioxide below or at that location in the formation may then be made by comparing the permeability to a threshold value at 350. A threshold permeability value of 50 μD or less is preferable, although higher or lower thresholds could be utilized. The entire procedure may then be repeated at other locations in the well-bore if desired in order to obtain a log or a chart of the permeability of the cement at different depths in the well-bore (see e.g., FIG. 8) and/or make determinations as to the suitability of storing carbon dioxide in the formation at different depths of the formation. The log or chart is provided in a viewable format such as on paper or on a screen. Also, if desired, after conducting a test at any location, the casing may be sealed (i.e., the hole repaired) as is known in the art.

The fitting of the relaxation time constant and the probe and formation pressures to the data for purposes of calculating the relaxation time constant and then the permeability can be understood as follows. The normalized pressure of the probe ($p_p$) is defined as the true pressure in the probe ($p_p^*$) minus the true pressure of the formation $p^*_f$.

$$p_p = p_p^* - p^*_f \tag{17}$$

The pressure decay may then be represented by restating equation (13) in light of equation (17) according to:

$$p_p^* = p_f^* + (p_w^* - p_f^*)e^{\frac{-t}{\tau}} \tag{18}$$

where $p^*_w$ is the true well-bore pressure.

To demonstrate how the data can be used to find the relaxation time, a synthetic pressure decay data set using equation

Figure 5:
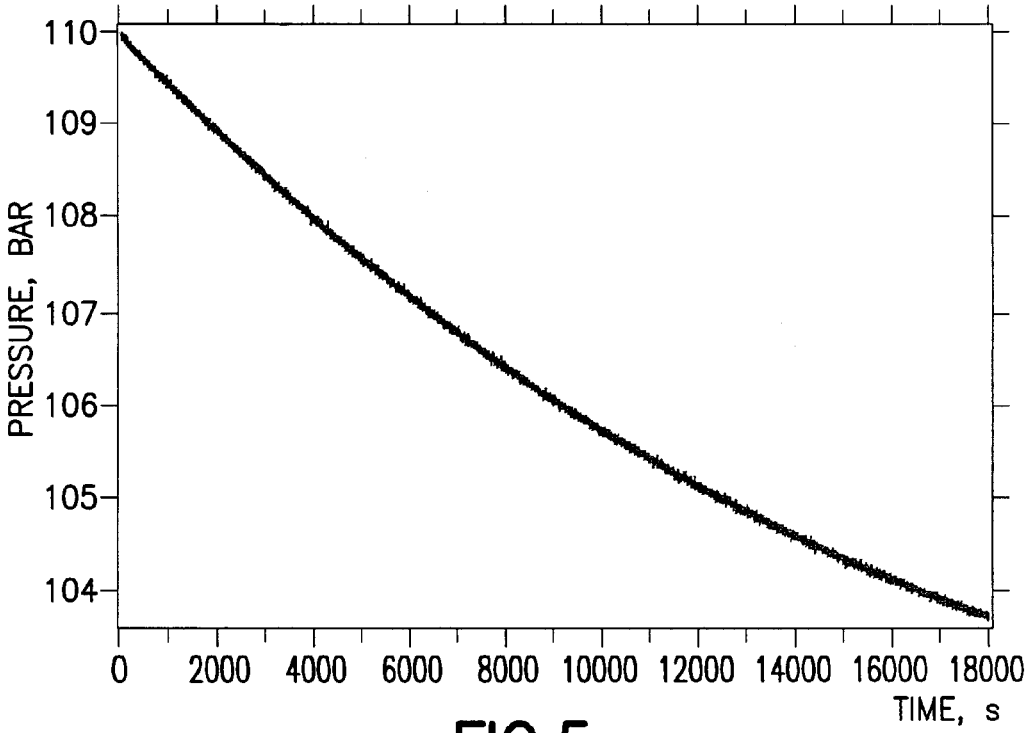
FIG. 5 is a plot of an example pressure decay measured by a probe over time.

(18) was generated with the following values: $p^*_f$=100 bar, $p^*_w$=110 bar, and the relaxation time τ=18,000 seconds (5 hours). Zero mean Gaussian noise with a standard deviation of 0.025 bar was added. FIG. 5 shows the pressure as would be measured by the pressure sensor in the tool. After five hours (18,000 seconds), the probe pressure is seen to approach 103.7 bar which indicates a 63% decay (i.e., which defines the relaxation time constant) towards the formation pressure.

Figure 6:
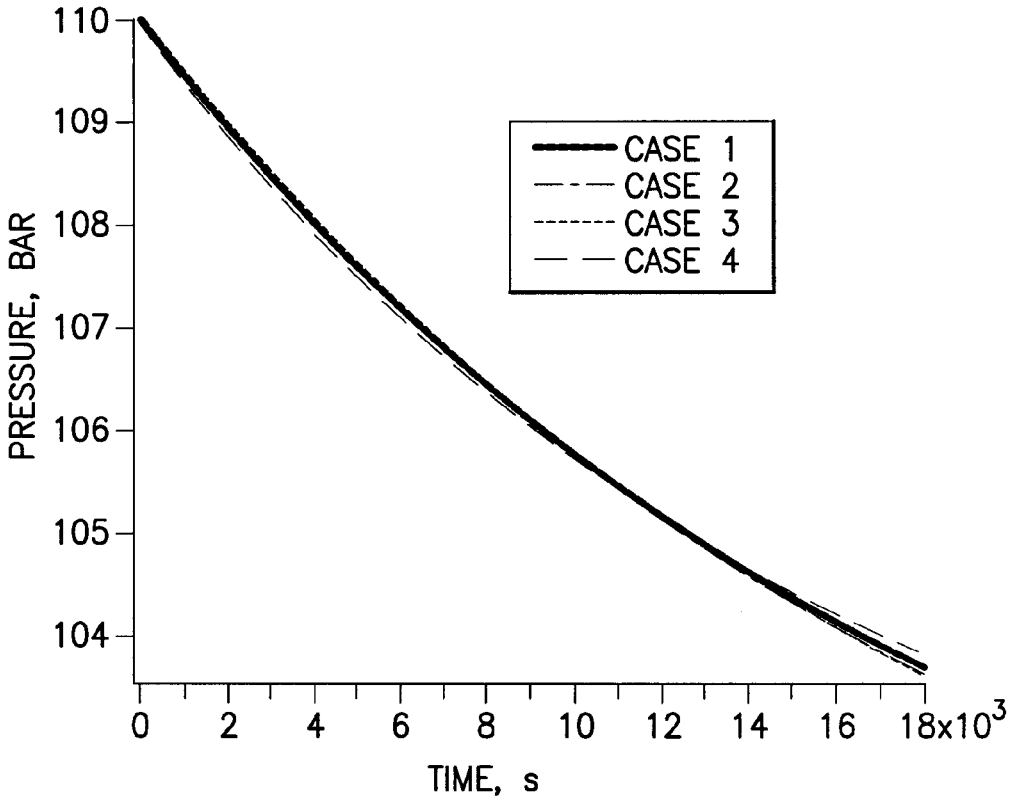
FIG. 6 shows plots of pressure decay as a function of time while fixing zero to two variables.

It is assumed that the probe is set and the pressure decay is measured, and the tool is withdrawn from contact with the cement annulus before the formation pressure is reached. In this situation, the formation pressure $p^*_f$ is unknown. Thus, equation (18) should be fit to the data with at least two unknowns: $p^*_f$ and τ. While the well-bore (probe) pressure is generally known, it will be seen that in fact it is best to fit equation (18) to the data assuming that the well-bore pressure is not known. Likewise, while it is possible to drill into the formation to obtain the formation pressure, it will be seen that in fact it is best to fit equation (18) to the data assuming that the formation pressure is not known. FIG. 6 shows the equation (18) fit to the data of FIG. 5 using four sets of assumptions: Case 1—three unknowns; Case 2—the well-bore pressure fixed at a value very close to the actual well-bore pressure (but slightly changed due to noise); Case 3—the well-bore pressure fixed at a value very close to the actual well-bore pressure and the formation pressure fixed at a value 1% less than the actual pressure; and Case 4—the well-bore pressure fixed at a value very close to the actual well-bore pressure and the formation pressure fixed at a value 1% higher than the actual pressure. As seen from Table 1, the best results are obtained by fitting the data using a least squares fitting technique with all three variables unknown, as the values obtained for Case 1 are closest to the actual synthetic values.

TABLE 1

| Case Number | p*f, bar | p*w, bar | τ, seconds |
|---|---|---|---|
| Case 1 | 100 ± 0.005 | 110 ± 0.0006 | 17,987 ± 15 |
| Case 2 | 100.09 ± 0.004 | 110.017 (fixed) | 17,717 ± 10 |
| Case 3 | 99 (fixed) | 110.017 (fixed) | 20,510 ± 3 |
| Case 4 | 101 (fixed) | 110.017 (fixed) | 15,374 ± 2 |

From Table 1, it is seen that by fixing the end-points (i.e., the formation and well-bore /probe pressures), the flexibility in fitting the decay rate is reduced.

Figure 7:
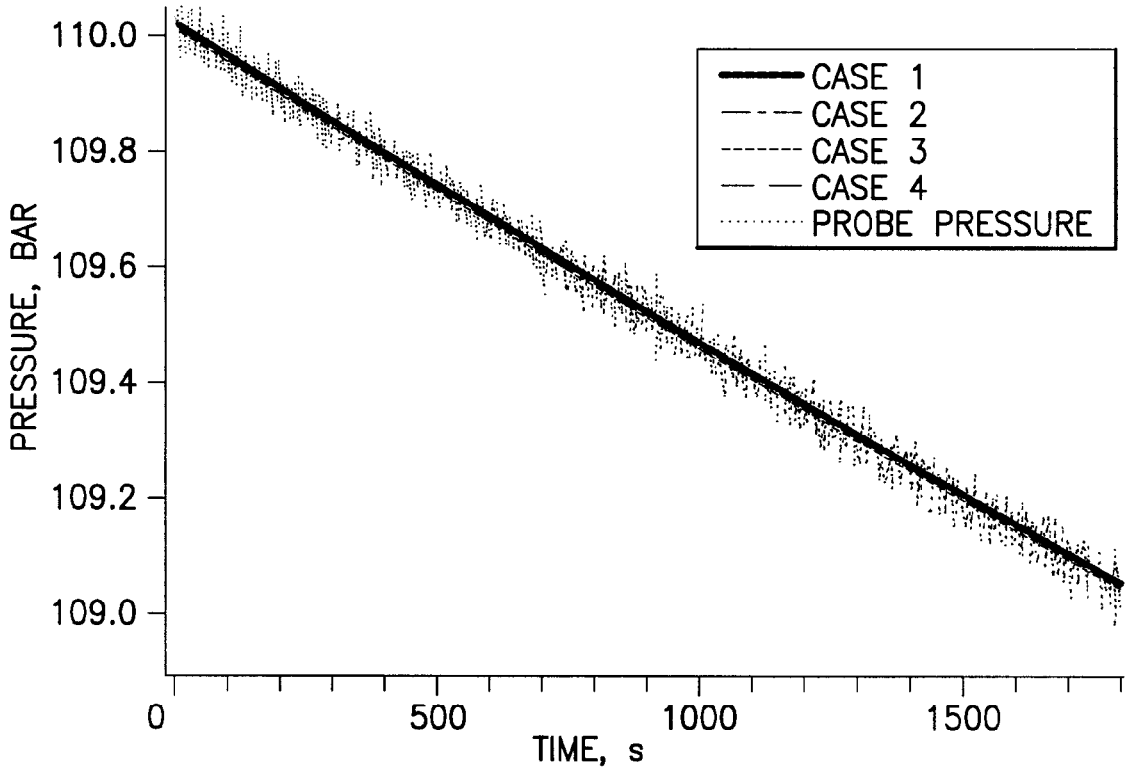
FIG. 7 are plots showing the fit of the pressure decay as a function of time while fixing zero to two variables when only the first 2000 seconds of the pressure test are used.

In accord with another aspect of the invention, the probe is withdrawn from contact with the cement annulus before the expected relaxation time (e.g., after 2000 seconds). FIG. 7 shows equation (18) fit to the first 2000 seconds of the data of FIG. 5 using the same four sets of assumptions set forth above with respect to Table 1. Again it is seen (from Table 2 below) that the best results are obtained where all three parameters are assumed unknown, as the values obtained for Case 1 are by far the closest to the actual synthetic values. It is noted that the small statistic error in the well-bore pressure assumption of Case 2 causes magnified error in the other variables. Thus, a three parameter fit is preferred unless extremely accurate estimates of both the well-bore pressure and formation pressure are available.

TABLE 2

| Case Number | p*f, bar | p*w, bar | τ, seconds |
|---|---|---|---|
| Case 1 | 100 ± 1 | 110 ± 0.02 | 17,392 ± 2200 |
| Case 2 | 104.39 ± 0.23 | 110.017 (fixed) | 9,559.7 ± 429 |
| Case 3 | 99 (fixed) | 110.017 (fixed) | 19,448 ± 18 |
| Case 4 | 101 (fixed) | 110.017 (fixed) | 15,778 ± 15 |

While excellent results are obtained in Case 1, it is noted that the uncertainty in the relaxation time is about 12.6% (over 100 times the uncertainty of the five hour test) and therefore will impact the permeability calculation of equation (15). However, in most situations, a factor of two or three (100%-200%) in the cement permeability determination is within acceptable limits. Thus, an approximately half-hour test will be sufficient in most cases.

According to another aspect of the invention, it is possible to test for the convergence of τ prior to terminating the test. In particular, the probe of the tool may be in contact with the cement annulus for a time period of T1 and the data may be fit to equation (18) to obtain a first determination of a relaxation time constant τ=τ1 along with its variation range. The test may then continue until time T2. The data between T1 and T2 and between t=0 and T2 may then be fit to equation (18) in order to obtain two more values τ12 and τ2 along with their ranges. All three relaxation time constants may then be compared to facilitate a decision as to whether to terminate or prolong the test. Thus, for example, if the relaxation time constant is converging, a decision can be made to terminate the test. In addition or alternatively, the formation pressure estimates can be analyzed to determine whether they are converging in order to determine whether to terminate or prolong a test.

There have been described and illustrated herein several embodiments of a tool and a method that determine the permeability of a cement annulus located in a formation. While particular embodiments of the invention have been described, it is not intended that the invention be limited thereto, as it is intended that the invention be as broad in scope as the art will allow and that the specification be read likewise. Thus, while testing for a full relaxation time constant has been described, as well as testing for 2000 seconds has been described, it will be appreciated that testing could be conducting for any portion of the relaxation time constant period, or even more than a full relaxation time constant period of desired. Also, while a particular arrangement of a probe and drill were described, other arrangements could be utilized. It will therefore be appreciated by those skilled in the art that yet other modifications could be made to the provided invention without deviating from its spirit and scope as claimed.

What is claimed is:

1. A method of determining an estimate of the permeability of a cement annulus in a formation traversed by a well-bore using a tool having a hydraulic probe and a pressure sensor, comprising:

locating the tool at a depth inside the well-bore with the hydraulic probe in hydraulic contact with the cement annulus;

using the pressure sensor to measure the pressure in the hydraulic probe over a period of time in order to obtain pressure data;

finding a relaxation time constant estimate of the pressure data by fitting the pressure data to an exponential curve which is a function of the relaxation time constant, and a difference between a starting pressure in the hydraulic probe and the formation pressure; and determining an estimate of the permeability of the cement annulus according to an equation which relates said permeability of the cement annulus to said relaxation time constant estimate.

2. A method according to claim 1, wherein:

the well-bore has a casing around which the cement annulus is located, and said locating the tool inside the well-bore includes selecting a location in the well-bore and setting the tool at that location, and drilling a hole in the casing to expose the cement annulus.

3. A method according to claim 2, wherein:

said drilling comprises monitoring torque on a drill bit, and terminating drilling based on a change of torque.

4. A method according to claim 3, wherein:

said drilling further comprising monitoring depth of penetration on of the drill bit, and terminating drilling based on said change of torque if the drill bit has penetrated to a depth approaching the thickness of the casing.

5. A method according to claim 1, wherein:

said relaxation time constant estimate is determined according to $$p_p^* = p_f^* + (p_w^* - p_f^*)e^{\frac{-t}{\tau}}$$

where $p^{p*}$ is the hydraulic probe pressure measured by the pressure sensor of the tool, $p^*_f$ is the formation pressure, $p^{w*}$ is the initial pressure at which the hydraulic probe is set, t is time, and $\tau$ is said relaxation time constant estimate.

6. A method according to claim 1, wherein:

said equation is $$k_c = V_t c_t \frac{\mu}{4\pi r_p}\left[1 - \frac{2\ln 2}{\pi}\frac{r_p}{l_c}\right],$$

where $k_c$ is said permeability estimate of said cement annulus, $\tau$ is said relaxation time constant estimate, $l_c$ is the thickness of said cement annulus, $V_t$ is the fluid volume of the lines of the tool connected to the hydraulic probe, $c_t$ is the compressibility of the fluid in the tool, $r_p$ is the radius of the hydraulic probe, and $\mu$ is the viscosity of the fluid in the tool.

7. A method according to claim 6, further comprising:

determining said compressibility of the fluid in the tool by imposing a known volume of expansion on the fixed amount of fluid in the system, sensing a resulting change in flow-line pressure, and calculating compressibility according to $$c_t = -\frac{1}{V}\frac{\Delta V}{\Delta p},$$

where V is an initial volume of the flow-line, $\Delta V$ is the expansion volume added to the flow line, and $\Delta p$ is the change in pressure.

8. A method according to claim 1, wherein:

said fitting comprises permitting said relaxation time constant estimate, said pressure in the hydraulic probe and said formation pressure to be variables which are varied to find a best fit.

9. A method according to claim 1, wherein:

said fitting comprises fixing at least one of said pressure in the hydraulic probe and said formation pressure in finding said relaxation time constant estimate.

10. A method according to claim 1, further comprising:

comparing said determined permeability estimate to a threshold value for the purpose of determining the suitability of storing carbon dioxide in the formation at or below that depth.

11. A method according to claim 1, wherein:

said period of time is less than said relaxation time constant estimate.

12. A method according to claim 1, further comprising:

generating a viewable log or chart showing at least one permeability estimate or indication of suitability for storing carbon dioxide at or below at least one depth in the formation.

13. A system for determining an estimate of the permeability of a cement annulus in a formation traversed by a well-bore having a casing, comprising:

a tool having a hydraulic probe, a pressure sensor in hydraulic contact with the hydraulic probe and sensing pressure in the hydraulic probe, a drill capable of drilling the casing, and means for hydraulically isolating said hydraulic probe in hydraulic contact with the cement annulus; and processing means coupled to said pressure sensor, said processing means for obtaining pressure measurement data obtained by said pressure sensor over a period of time while said hydraulic probe is hydraulically isolated in hydraulic contact with the cement annulus, for finding a relaxation time constant estimate of the pressure data by fitting the pressure data to an exponential curve which is a function of the relaxation time constant, and a difference between a starting pressure in the hydraulic probe and the formation pressure, and for determining an estimate of the permeability of the cement annulus according to an equation which relates said permeability of the cement annulus to said relaxation time constant estimate.

14. A system according to claim 13, wherein:

said processing means is at least partially located separate from said tool.

15. A system according to claim 13, further comprising:

means coupled to said processing means for generating a viewable log or table of at least one estimate of the permeability of the cement annulus as a function of depth in the well-bore or formation.

16. A system according to claim 13, wherein:

said processing means for finding said relaxation time constant estimate finds said relaxation time constant according to $$p_p^* = p_f^* + (p_w^* - p_f^*)e^{\frac{-t}{\tau}}$$

where $p_p*$ is the hydraulic probe pressure measured by the pressure sensor of the tool, $p^*_f$ is the formation pressure, $p^{w*}$ is the initial pressure at which the hydraulic probe is set, t is time, and $\tau$ is said relaxation time constant estimate.

17. A system according to claim 13, wherein:

said equation is $$k_c = V_t c_t \frac{\mu}{4\tau r_p}\left[1 - \frac{2\ln 2}{\pi}\frac{r_p}{l_c}\right],$$

where $k_c$ is said permeability estimate of said cement annulus, $\tau$ is said relaxation time constant estimate, $l_c$ is the thickness of said cement annulus, $V_t$ is the fluid volume of the lines of the tool connected to the hydraulic probe, $c_t$ is the compressibility of the fluid in the tool, $r_p$ is the radius of the hydraulic probe, and $\mu$ is the viscosity of the fluid in the tool.

* * * * *